US005313750A

United States Patent [19]

Frecska et al.

[11] Patent Number: 5,313,750

[45] Date of Patent: May 24, 1994

[54] FIRE-RATED RUNNER

[75] Inventors: Sandor A. Frecska, Lancaster, Pa.; Gale E. Sauer, Sinclairville, N.Y.

[73] Assignee: Armstrong World Industries, Inc., Lancaster, Pa.

[21] Appl. No.: 864,315

[22] Filed: Apr. 6, 1992

[51] Int. Cl.[5] ..... E04B 9/08

[52] U.S. Cl. ..... 52/232; 52/573.1; 52/DIG. 5; 52/506.07

[58] Field of Search ..... 52/484, DIG. 5, 232, 52/573

[56] References Cited

U.S. PATENT DOCUMENTS

| | | | |
|---|---|---|---|
| 3,189,139 | 6/1965 | Znamirowski | 52/232 |
| 3,778,947 | 12/1973 | Sauer | 52/232 |
| 4,713,919 | 12/1987 | Platt | 52/232 |

*Primary Examiner*—Carl D. Friedman
*Assistant Examiner*—Matthew E. Leno

[57] ABSTRACT

The grid member is formed of sheet metal and has an inverted T-shape with a bulb at the top, a double thickness central web and oppositely disposed flanges at the bottom. To achieve controlled expansion, an extended angular lance is cut at the top of the bulb. No metal is removed at this area of maximum bending stress. Further, staggered cutouts are placed in the two thicknesses which make up the web. By staggering the cutout areas of adjacent web layers, the overall web strength is maintained. These web cutouts and the lance at the top of the bulb cooperate upon thermal expansion, causing the bottom flanges to buckle down, and the web and bulb to separate laterally and fold. The folded web configuration directed by the staggered cutout pattern will maintain longitudinal rigidity.

3 Claims, 2 Drawing Sheets

FIRE-RATED RUNNER

BACKGROUND OF THE INVENTION

Field of the Invention

This invention relates generally to a fire-resistant, ceiling board supporting grid system, and more particularly, to runner members capable of absorbing compressive elongation without substantial buckling as might occur during abnormal elevated temperatures, thereby preserving the integrity of the ceiling as a fire barrier under such conditions.

One of the critical problems encountered in these supporting grid structures is to maintain integrity under abnormally elevated temperatures, such as during a fire. Under these high temperature conditions, metallic grid members, which generally are fixed at their end points, expand and buckle whereby the supported ceilin9 panels are displaced and drop throu9h the openings formed by the buckled grid members. As a result, the effectiveness of the suspended ceiling as a fire barrier is destroyed and the support structure is exposed to fire.

Prior art has considered structures for absorbing thermally induced compression in a supporting grid member. Most of the early designs used multiple expansion joints in a main runner. A relatively close placement of expansion joints will perform best in fire. This is because, when subjected to fire, the intersecting cross tees will remain close to their original spacings and thereby continue to support the panels. The early systems, however, were severely weakened at their expansion relief locations and could not be installed efficiently without excessive handling damage. Further, they were weak in cross bending and could not maintain beam alignment when exposed to fire.

To resolve this problem, some of the commercial systems reverted to main beams with only one relief point located near the end of the runner (reference U.S. Pat. No. 3,388,519). This however, reduced the handling problem at the expense of optimum fire performance.

Over the years there have been step-by-step improvements in systems that use multiple relief points in each main runner. However, the above problems, to a lesser degree, remain valid even in the improved systems. U.S. Pat. Nos. 3,778,947, 3,965,631 and 4,606,166 show products that handle marginally well when the web is kept vertical. The crushed bulb of these designs, however, limits handleability. This is especially true when a beam is handled on its side. U.S. Pat. Nos. 4,016,701 and 4,128,978 show products with metal removed from the top of the bead. This is the area of maximum bending stress, and the removal of metal here will significantly reduce load carrying capacity.

SUMMARY OF THE INVENTION

Accordingly, one object of the present invention is to provide an improved fire-rated grid member which absorbs longitudinal compression resulting from extreme heat and provides controlled deformation at predetermined areas so as to preserve the integrity of a supported fire-resistive ceiling.

Another object of this invention is to provide a fire-rated grid member with multiple relief points, which is less fragile to damage in handling.

Still another object of the present invention is to provide a grid member with stronger expansion relief areas, which can better withstand ceiling loads in a normal situation and at extreme temperatures.

A further object of the present invention is to provide an improved fire-rated grid member which may be manufactured with less complex tooling.

In summary, the present invention provides a fire-rated grid member with multiple areas which provide expansion relief when exposed to high temperatures. The grid member is formed from a strip of metal into the shape of an inverted T-shape with a bulb at the top, a double thickness central web and oppositely disposed flanges at the bottom.

The areas of expansion are configured with an extended Z-shaped lance across the top of the bulb. Metal is not removed from the top of the bulb, nor is the bulb crushed or formed in a manner which could weaken the section to lateral bending. A knock-out pattern is placed in the two web thicknesses. These web cutting patterns occur staggered on the adjacent web thicknesses to maintain greater strength. When the grid member is put into compression, as would occur in high temperatures, the expansion relief area will buckle in a controlled manner. The flange will fold down, and the bulb and webs directed by the cut and lance patterns will slip laterally past each other. A relatively rigid section will remain after the expansion relief has occurred.

DESCRIPTION OF THE PREFERRED EMBODIMENTS

Figure 1:
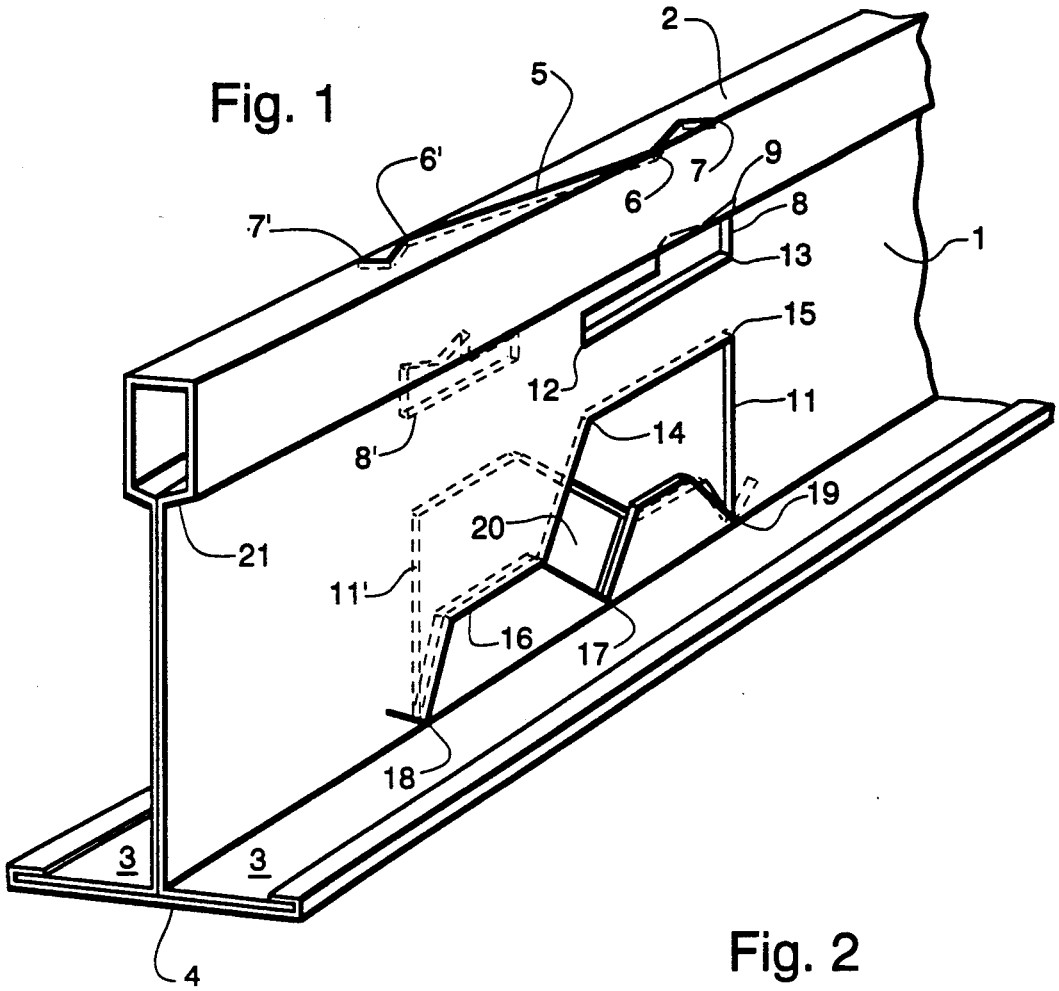
FIG. 1 is a perspective view of the expansion relief area within the grid member. Hidden lines are used to show the web cutouts hidden from view.
Figure 3:
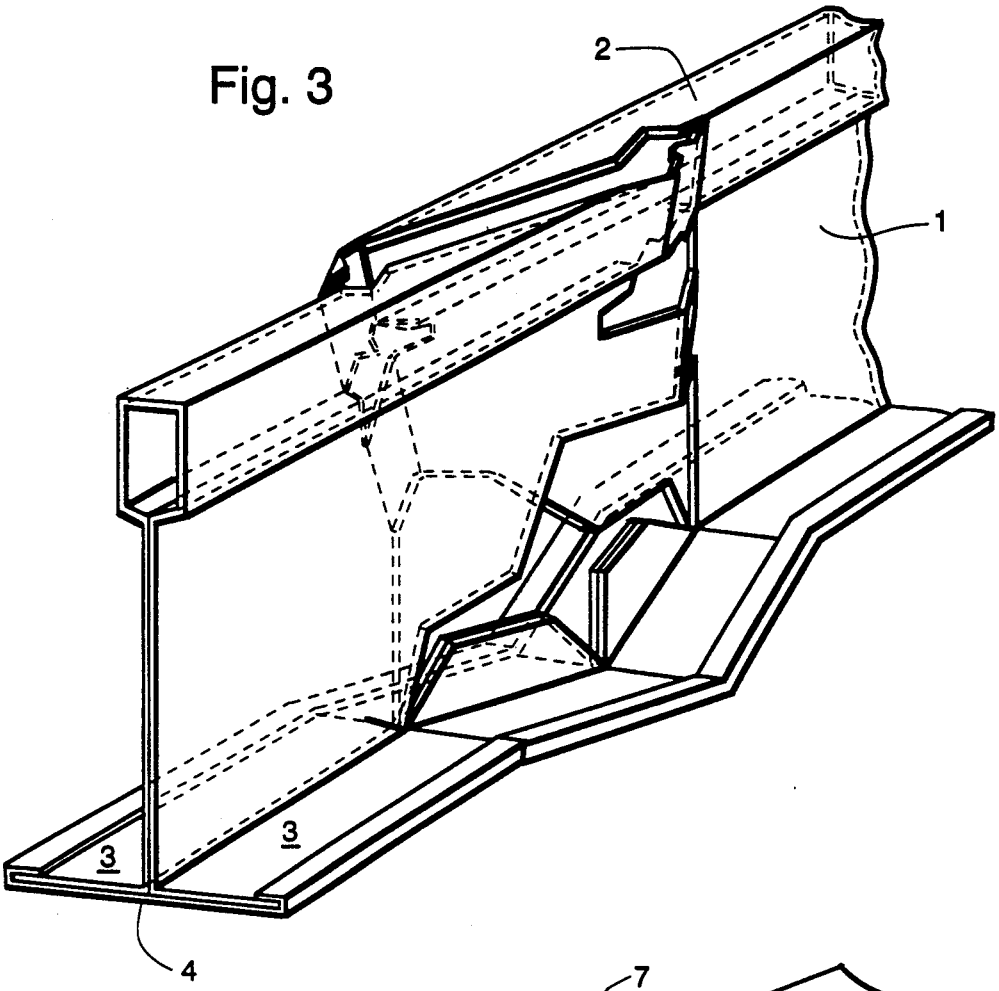
FIG. 3 is a perspective of the grid member which has undergone thermal expansion.
Figure 4:
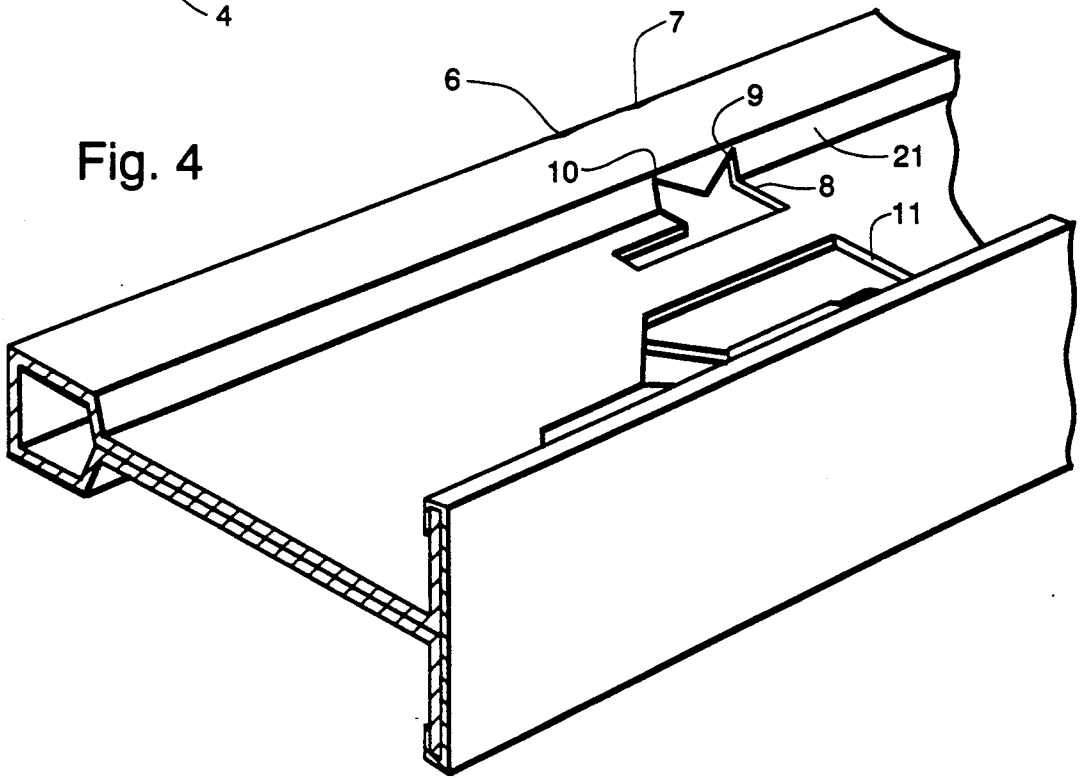
FIG. 4 is a side view of the web cutout.

Referring to FIGS. 1, 3 and 4, there is shown a fire-rated runner having an inverted T-construction which includes a central web 1, having a bulb 2 at the top and a pair of oppositely disposed flanges 3 at the bottom for supporting ceiling panels. The fire-rated runner is of the double web type in which a strip of sheet metal is bent intermediate its longitudinal edges to form the bulb 2 with the portion of the strip at opposite sides of the bulb being brought into parallel relation to form the web 1 and the edge portions of the strip being bent at right angles thereto to form the oppositely disposed flanges 3. A separate decorative cap 4 covers the flanges and is formed by a strip of material having its longitudinal edges folded around the adjacent edges of the associated flanges 3. The runner just described is generally of standard construction as utilized in the trade.

Figure 2:
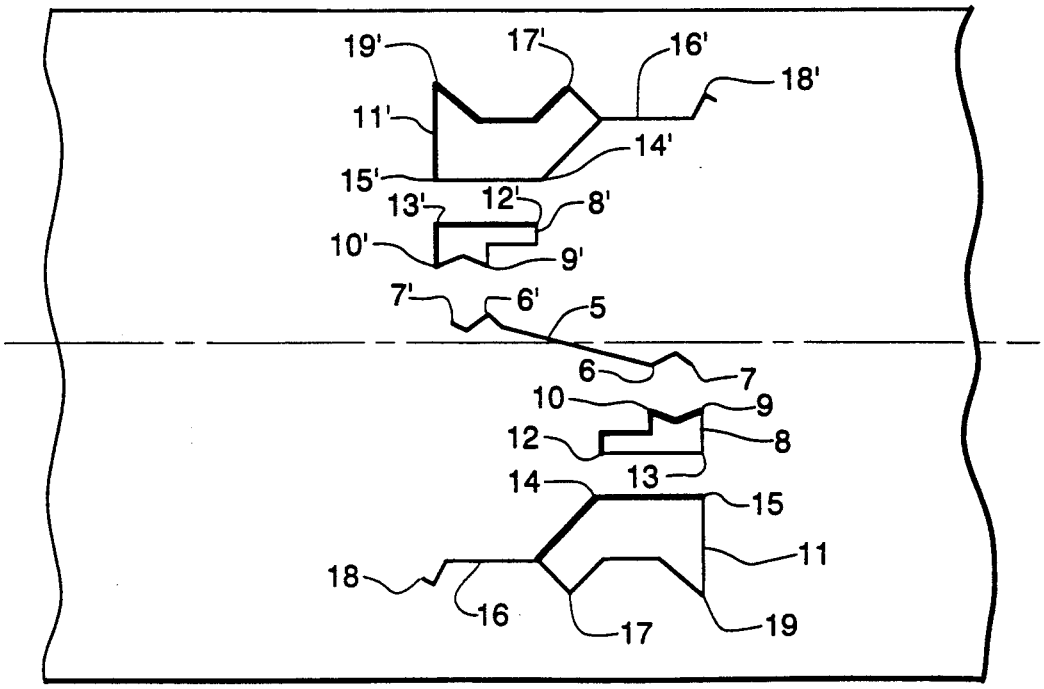
FIG. 2 is a segment of the metal strip before it is formed into a T-section. The segment shows the cutout pattern which becomes the expansion relief area of the grid member.

The expansion areas of the fire-rated beam are created by a cutout and lance pattern as shown in FIG. 1. To eliminate distortions to the bulb, and to simplify the process and tooling, the cutout and lance pattern is punched into the metal strip before it is formed into an inverted T. FIG. 2 shows this pattern applied to the strip of metal before it is formed. FIG. 3 shows the expansion area of the fire-rated runner after it has functioned to relieve thermal expansion.

The many features of the cutout and lance patterns, as shown in FIGS. 1 and 4, cooperate to achieve the controlled expansion shown in FIG. 3.

At the top of the bulb is a elongated angled lance 5. With an extreme compressive force longitudinal to the bulb, one side of the angled lance is urged to slip past the other side of the angled lance. Then as this compressive slippage starts to occur, due to the angular shape of the lance, the bulb is urged laterally in both directions.

Note points 6 and 7 at one end of the angular lance on the bulb. Both points fall at the edge of the top wall of the bulb where it meets the side wall of the bulb. Note cutout or side cut 8 of FIG. 4 which removes metal from one side of the web and the bottom wall 21 of the bulb. Points 9 and 10 occur within cutout 8 and are in vertical alignment with points 6 and 7, respectively.

An identical, but reversed, lance and cut configuration occurs at the opposite side of the top of the bulb 6', 7', and the opposite side of the web 8', 9' and 10'.

Now as a compressive force urges opposite sides of the angled lance to separate and the bulb is thereby urged laterally in both directions, staggered metal hinge lines develop on opposite sides of the bulb. These staggered metal hinge lines develop at 6–9, 7–10, 6'–9' and 7'–10'. As the compression continues, the metal about these four hinge lines can move up to 180 degrees. As shown in FIG. 3, lines 6–9 and 6'–9' have made about a 60° arc around lines 7–10 and 7'–10', respectively.

In order for the above to occur, there must be equal longitudinal expansion relief in the web and in the bottom flange. Cutout 11 and 11' account for the controlled expansion relief in the two web thicknesses. Additional vertical hinge lines develop at 12–14, 12'–14', 13–15 and 13'–15'. The web metal adjacent these hinge lines will move in sequence with the bulb metal as noted above.

An optional feature to this invention would be to crease the above noted hinge lines a small amount in the direction they are to function.

As the bulb and the web relieve expansion by one side rotating laterally around the other side, the flange 3 will buckle downward. The lower edge of cutouts 11 and 11' and lance 16 and 16' free the flange from the web at the expansion relief area. The V-shaped notch in the web 1 which is in close proximity to the flange will permit the flanges to buckle. This controlled flange buckling is also facilitated by cuts 18 and 19 which are also cut close to the flange. To direct the flange to buckle down and not up, notch 17 must be closer to the flange than cuts 18 and 19. Notch 17 and cuts 18 and 19 are collectively called cuts.

FIG. 3 shows the relief area of the main runner partly collapsed in the above-described controlled manner.

Features unique to this invention make this expansion relief stronger than the earlier designs. The elongated angled lance along the top of the bulb is one of those features. When an inverted T-beam is loaded, the metal at the top of the bulb must carry a longitudinal stress which is greater there than any other area of the section. A removal of material at the top of the bulb or a lance normal to the beam direction would remove stress resistance is this critical area. In such a case, the section would have a reduced load carrying capacity.

Further, the bulb is not weakened by forming or crushing intended to direct expansion relief as in earlier designs.

A totally unique feature to this invention is the staggered cut and lance pattern on the two adjacent web pieces. There is only a small through cut area 20 where both web thicknesses are through cut in the same area. This enhances twist resistance and handleability. Where one side of the web is weakened for expansion relief the other adjacent side of the web remains intact to resist distortion. This feature also permits greater load carrying capability to be maintained after the thermal expansion has occurred.

What is claimed is:

1. A fire expansion section for a ceiling runner wherein:

(a) the ceiling runner has two ends, a vertical web member having at its upper end a bulb-shaped element with two spaced side walls, a two piece bottom wall and a top wall, and at its lower end oppositely positioned flanges on either side of the web to support ceiling boards, said web member consisting of two side-by-side pieces of metal, each piece integral with and connected at the bottom of the web to one of the oppositely positioned flanges and integral with and connected at the top of the web to one of the bottom wall pieces of the bulb; and (b) said fire expansion section being located between the two ends of the ceiling runner and said section comprising:

(1) a slit cut in the top wall of the bulb-shaped element without the removal of metal;

(2) a first rectangular cutout in one piece of the metal of the web at the top of the web adjacent the bulb bottom wall near and below one end of the slit and a second rectangular cutout similarly located in the other piece of metal of the web near and below the other end of the slit;

(3) three evenly spaced apart cuts in the web near the flangges, the center cut at its position near the flange being V-shaped with the point of the V-shape positioned near the flange to form a notch, the center cut being cut through both pieces of metal forming the web to form an opening in the web less than 50% of the sum of the rectangular cutout area in each piece of metal in the web, on one side of the web the cut on the right side of the center notch as viewed facing said one side being cut through only said one piece of metal forming the web with the cut located below the rectangular cutout on said one side of metal, on the other side of the web the cut on the right side of the center notch as viewed facing said other side being cut through said other piece of metal forming the web and positioned in the same manner as the cut on the said one side of the web; and (4) the upper ends of the three cuts being connected by a severance of the metal above the cuts.

2. A fire expansion section for a ceiling runner as set forth in claim 1 wherein:

(a) the severance of the metal above the cuts is a removal of metal above the right side cut in the metal and a slit cut in the metal adjacent the left side of the center cut.

3. A fire expansion section for a ceiling runner as set forth in claim 1 wherein:

(a) the rectangular cutout in one piece of the metal of the web at the top of the web extends into the bottom wall of the bulb.

* * * * *